US010839742B2

(12) United States Patent
Wu et al.

(10) Patent No.: US 10,839,742 B2
(45) Date of Patent: Nov. 17, 2020

(54) DISPLAY APPARATUS AND ELECTRONIC DEVICE

(71) Applicant: Lenovo (Beijing) Co., Ltd., Beijing (CN)

(72) Inventors: Hailong Wu, Beijing (CN); Nan Lin, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 15/941,332

(22) Filed: Mar. 30, 2018

(65) Prior Publication Data

US 2019/0096319 A1 Mar. 28, 2019

(30) Foreign Application Priority Data

Sep. 25, 2017 (CN) ..... 2017 1 0872646

(51) Int. Cl.
*G09G 3/3208* (2016.01)
*G09G 3/20* (2006.01)

(52) U.S. Cl.
CPC ..... *G09G 3/3208* (2013.01); *G09G 3/2003* (2013.01); *G09G 2300/0452* (2013.01); *G09G 2300/0465* (2013.01); *G09G 2320/0257* (2013.01); *G09G 2320/046* (2013.01)

(58) Field of Classification Search
CPC ..... G09G 3/3208
USPC ..... 345/76–78
See application file for complete search history.

(56) References Cited

U.S. PATENT DOCUMENTS

2007/0040820 A1* 2/2007 Lee ..... G06F 1/3218 345/204
2007/0286944 A1 12/2007 Yokoyama et al.
2010/0053043 A1* 3/2010 Sakamoto ..... H01L 27/3213 345/77
2010/0309096 A1* 12/2010 Inoh ..... G09G 3/20 345/5
2014/0152637 A1* 6/2014 Fujita ..... C07F 15/002 345/211

(Continued)

FOREIGN PATENT DOCUMENTS

CN 104009064 A 8/2014
CN 105027313 A 11/2015
CN 105679798 A 6/2016

(Continued)

OTHER PUBLICATIONS

Jianyong Zhao, "Organic light emitting diode (OLED) display technology," Paragraph 1.3 Colorization of OLED, Full text and drawings, Beijing: National Defense Industry Press, Jul. 31, 2017, 5 pages.

*Primary Examiner* — Roy P Rabindranath
(74) *Attorney, Agent, or Firm* — Anova Law Group, PLLC

(57) ABSTRACT

A display apparatus includes an organic light-emitting layer including a plurality of display units. The plurality of display units include one or more first type display units in a first display region and one or more second type display units in a second display region. Each of the one or more first type display units includes one or more white light diodes and one or more light filter components each arranged in a light exit direction of one of the one or more white light diodes. Each of the one or more second type display units includes a red light diode, a green light diode, and a blue light diode.

9 Claims, 3 Drawing Sheets

(56) References Cited

U.S. PATENT DOCUMENTS

| | | | | |
|---|---|---|---|---|
| 2015/0294616 | A1* | 10/2015 | Jang | G09G 3/3208<br>345/691 |
| 2015/0380470 | A1 | 12/2015 | Lee et al. | |

FOREIGN PATENT DOCUMENTS

| | | | |
|---|---|---|---|
| CN | 106098720 | A | 11/2016 |
| CN | 106158907 | A | 11/2016 |
| CN | 106444156 | A | 2/2017 |

* cited by examiner

DISPLAY APPARATUS AND ELECTRONIC DEVICE

CROSS-REFERENCE TO RELATED APPLICATION

This application claims priority to Chinese Patent Application No. 201710872646.2, filed on Sep. 25, 2017, the entire contents of which are incorporated herein by reference.

TECHNICAL FIELD

The present disclosure generally relates to the field of display technologies and, more particularly, to an organic light-emitting diode (OLED) display apparatus and an OLED electronic device.

BACKGROUND

More and more electronic devices, such as smart phones, use organic light-emitting diode (OLED) display screens. Conventional OLED display screens usually adopt three-color OLED technologies. In the three-color OLED technologies, the color display is realized through a red light diode, a green light diode, and a blue light diode. However, a long time display of a fixed image in such an OLED display screen can result in attenuation of red/green/blue pixel luminance, and thus a ghost image can occur. Accordingly, a user visual experience may be relatively poor.

SUMMARY

In one aspect, the present disclosure provides a display apparatus including an organic light-emitting layer including a plurality of display units. The plurality of display units include one or more first type display units in a first display region and one or more second type display units in a second display region. Each of the one or more first type display units includes one or more white light diodes and one or more light filter components each arranged in a light exit direction of one of the one or more white light diodes. Each of the one or more second type display units includes a red light diode, a green light diode, and a blue light diode.

Another aspect of the present disclosure provides an electronic device including a display apparatus. The display apparatus includes an organic light-emitting layer including a plurality of display units. The plurality of display units include one or more first type display units in a first display region and one or more second type display units in a second display region. Each of the one or more first type display units includes one or more white light diodes and one or more light filter components each arranged in a light exit direction of one of the one or more white light diodes. Each of the one or more second type display units includes a red light diode, a green light diode, and a blue light diode.

BRIEF DESCRIPTION OF THE FIGURES

The following drawings are merely examples for illustrative purposes according to various disclosed embodiments and are not intended to limit the scope of the present disclosure.

DETAILED DESCRIPTION OF EMBODIMENTS

Embodiments of the disclosure will now be described in more detail with reference to the drawings. It is to be noted that, the following descriptions of some embodiments are presented herein for purposes of illustration and description only, and are not intended to be exhaustive or to limit the scope of the present disclosure.

The aspects and features of the present disclosure can be understood by those skilled in the art through the embodiments of the present disclosure further described in detail with reference to the accompanying drawings.

Figure 1:
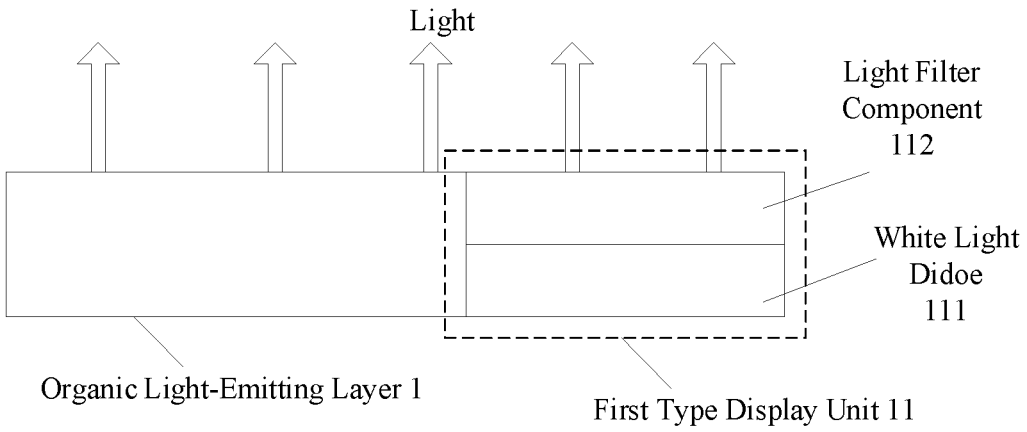
FIG. 1 is a schematic view of an example of organic light-emitting diode (OLED) display apparatus consistent with disclosed embodiments.

The present disclosure provides an organic light-emitting diode (OLED) display apparatus. FIG. 1 is a schematic view of an example of OLED display apparatus consistent with disclosed embodiments. As shown in FIG. 1, the display apparatus includes an organic light-emitting layer 1 including a plurality of display units. A display unit may also be referred to as a "display sub-circuit." The plurality of display units form a display output region of the display apparatus. Each display unit may correspond to a pixel that at least includes three primary colors. The plurality of display units at least include a first type display unit 11. The first type display unit 11 includes a white light diode 111 and a light filter component 112 arranged in a light exit direction of the white light diode 111.

In some embodiments, the display apparatus may use the organic light-emitting layer 1 as a light source to realize a color display function, and light exit regions of the organic light-emitting layer 1 may correspond to an entire display output region of the display apparatus. The organic light-emitting layer 1 may include a plurality of display units, and the plurality of display units may at least include the first type display unit 11. The first type display unit 11 may include the white light diode 111 and the light filter components arranged in a light exit direction of the white light diode 111. The white light-emitting diode 111 may include, for example, a white OLED.

Figure 2:
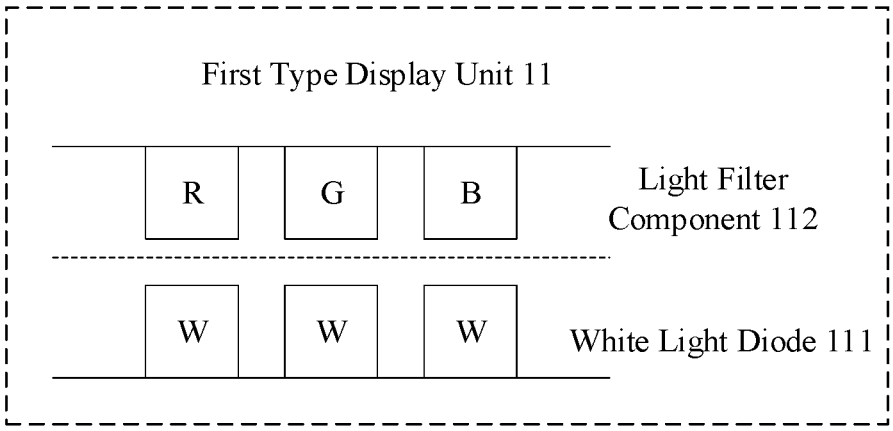
FIG. 2 is a schematic view of an example of first type display unit in an OLED display apparatus consistent with disclosed embodiments.

FIG. 2 is a schematic view of an example of first type display unit in an OLED display apparatus consistent with disclosed embodiments. In the example shown in FIG. 2, the first type display unit includes multiple light filter components 112, e.g., a red light filter component, a green light filter component, and a blue light filter component, as indicated by "R," "G," and "B" in the light filter components 112 shown in FIG. 2. The red light filter component (R), the green light filter component (G), and the blue light filter component (B) are arranged side by side. When the red light filter component, the green light filter component, and the blue light filter component receive white light emitted by the white light diode(s) 111, the red light filter component, the green light filter component, and the blue light filter component can emit red light, green light, and blue light, respectively. The red light, the green light, and the blue light can be combined to form color light. In some embodiments, one light filter component may be arranged in a light exit direction of each white light diode 111, and one light filter component may include a red light filter component, a green light filter component, or a blue light filter component. In some embodiments, for each pixel in the display output region corresponding to the first type display units 11, at least one group of white light diodes 111 may be provided. Each group of white light diodes 111 may include three white light diodes 111. A red light filter component, a green light filter component, and a blue light filter component may be arranged in the light exit directions of the three white light diodes 111, respectively. Operation statuses of the white light diodes 111 may be controlled to obtain color light. In some embodiments, for three white light diodes 111 corresponding to each pixel, whether each of the red light, the green light, and the blue light is emitted may be adjusted by controlling the on/off statuses of the three white light diodes 111. Display parameters of emitted red light, green light, and blue light may be adjusted by separately adjusting display parameters of the three white light diodes 111. Further, the emitted light may be combined to obtain color light corresponding to the pixel.

A thickness of the light filter component 112 may not exceed a preset threshold. The preset threshold may be, for example, approximately 0.5 mm. That is, the thickness of the light filter component 112 may not exceed approximately 0.5 mm. Accordingly, a thickness of the OLED display apparatus may be ensured to be, e.g., relatively small.

In the present disclosure, color display of a display apparatus may be realized through a combination of white light diodes and light filter components. Under a same current condition, white light diodes may have a relatively higher luminance, relatively longer lifetime, and relatively better stability than red light diodes, green light diodes, and blue light diodes. Accordingly, ghost images in the display apparatus may be suppressed, and user visual experience may be improved.

Figure 3:
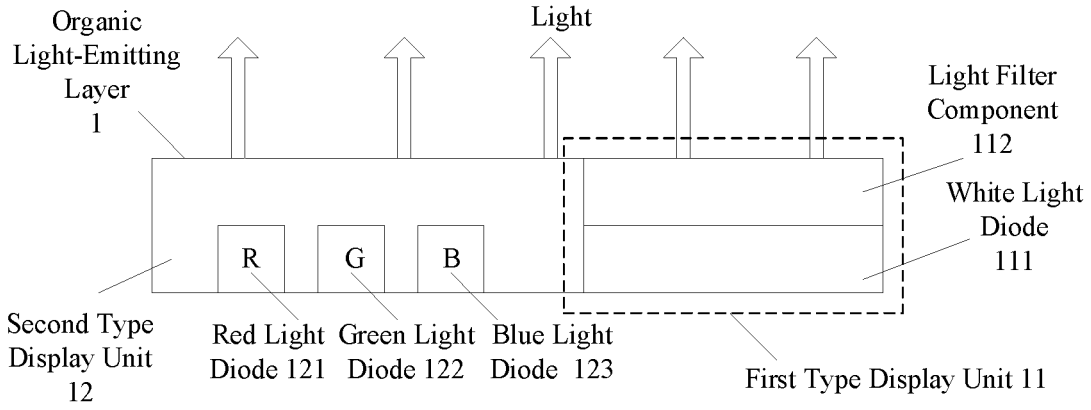
FIG. 3 is a schematic view of another example of OLED display apparatus consistent with disclosed embodiments.

In addition to the above-described examples, the present disclosure also provides another OLED display apparatus. FIG. 3 is a schematic view of another example of OLED display apparatus consistent with disclosed embodiments. The organic light-emitting layer 1 of the display apparatus shown in FIG. 3 includes a plurality of display units. The plurality of display units form a display output region of the display apparatus. The plurality of display units at least include the first type display unit 11. The first type display unit 11 includes the white light diode 111 and the light filter component 112 arranged in a light exit direction of the white light diode 111.

The plurality of display units further include a second type display unit 12. The second type display unit 12 includes a red light diode 121, a green light diode 122, and a blue light diode 123.

That is, the display apparatus shown in FIG. 3 is similar to the display apparatus shown in FIG. 2, except that in the display apparatus shown in FIG. 3, the plurality of display units in the organic light-emitting layer 1 further include the second type display unit 12. The second type display unit 12 includes a red light diode 121, a green light diode 122, and a blue light diode 123. The red light diode 121, the green light diode 122, and the blue light diode 123 may be realized by, for example, OLEDs.

The red light diode 121, the green light diode 122, and the blue light diode 123 may emit red light, green light, and blue light, respectively. Further, color light may be obtained through a combination of the red light, the green light, and/or the blue light. In some embodiments, for each pixel in a display output region corresponding to the second type display unit 12, at least one group of red light diode 121, green light diode 122, and blue light diode 123 may be provided. By controlling on/off statuses of the red light diode 121, the green light diode 122, and the blue light diode 123, whether each of the red light, the green light, and the blue light is emitted may be adjusted. Display parameters of emitted red light, green light, and blue light may be adjusted by separately adjusting display parameters of the red light diode 121, the green light diode 122, and the blue light diode 123. Further, the emitted light may be combined to obtain color light corresponding to the pixel.

In some embodiments, the plurality of display units may form a display output region of the display apparatus, and the display output region may include a first region and a second region. The first region may include an edge region corresponding to the second region, e.g., a region adjacent to an edge of the second region. The first region may include an edge region corresponding to one edge of the second region. The first region may have a smaller area than the second region. A length of a long side of the first region may be equal to a length of one side of the second region. In some embodiments, a shape of the first region may be, for example, an irregular shape. When an OLED display apparatus is used in an electronic device, the first region located at the edge region corresponding to one edge of the second region may be compatible with a shape of an edge of a display output region of the electric device.

In some embodiments, the first region may correspond to the first type display units 11, and the second region may correspond to the second type display units 12. That is, the first region may use the white light diodes 111 as light-emitting sources, and the second region may use the red light diodes 121, the green light diodes 122, and the blue light diodes 123 as light-emitting sources, also referred to as "light sources."

In the present disclosure, color display in the first region of the display output region of the display apparatus may be realized through a combination of white light diodes and light filter components, and color display in the second region of the display output region of the display apparatus may be realized through red light diodes, green light diodes, and blue light diodes. Under a same current condition, white light diodes may have relatively higher luminance, relatively longer lifetime, and relatively better stability than red light diodes, green light diodes, and blue light diodes. Accordingly, ghost images in the first region may be suppressed, and user visual experience may be improved.

In addition to the above-described examples, the present disclosure also provides another OLED display apparatus. The organic light-emitting layer 1 of the display apparatus shown in FIG. 4 includes a plurality of display units. The plurality of display units form a display output region of the display apparatus. The plurality of display units at least include the first type display unit 11. The first type display unit 11 includes the white light diode 111 and the light filter component 112 arranged in a light exit direction of the white light diode 111.

The plurality of display units further include the second type display unit 12. The second type display unit 12 includes the red light diode 121, the green light diode 122, and the blue light diode 123.

The display apparatus further includes a glass substrate 2. Light filter components 112 of the first type display unit are arranged in a region at an inner surface of the glass substrate 2, and the region at the inner surface corresponds to, e.g., directly faces, the first region.

Figure 4:
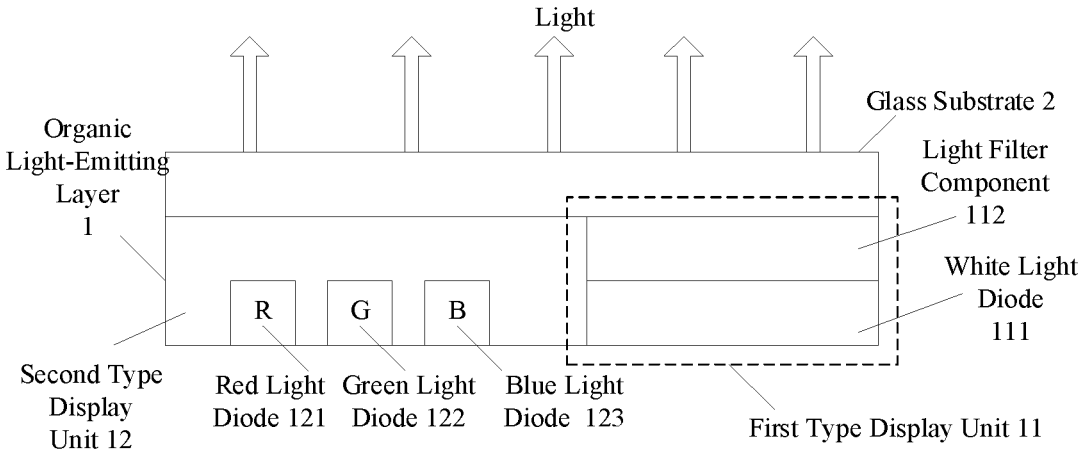
FIG. 4 is a schematic view of another example of OLED display apparatus consistent with disclosed embodiments.

That is, the display apparatus shown in FIG. 4 is similar to the display apparatus shown in FIG. 3, except that the display apparatus shown in FIG. 4 further includes the glass substrate 2 for protecting the organic light-emitting layer 1. The light filter component 112 can be realized in a form of color thin film. By a spray-coating method, the color thin film can be spray-coated at an inner surface of the glass substrate 2 and in a region corresponding to the first region. Since the thin film is relatively thin, a thickness of the light filter component 112 can be reduced by spay-coating the thin film to form the light filter component 112. Accordingly, a thickness of the display apparatus can be reduced.

In addition to the above-described examples, the present disclosure also provides another OLED display apparatus. The organic light-emitting layer 1 of the display apparatus shown in FIG. 5 includes a plurality of display units. The plurality of display units form a display output region of the display apparatus. The plurality of display units at least include the first type display unit 11. The first type display unit 11 includes the white light diode 111 and the light filter component 112 arranged in a light exit direction of the white light diode 111.

The plurality of display units further include the second type display unit 12. The second type display unit 12 includes the red light diode 121, the green light diode 122, and the blue light diode 123.

The display apparatus further includes the glass substrate 2. Light filter components 112 of the first type display unit are arranged in a region at an inner surface of the glass substrate 2, and the region at the inner surface corresponds to, e.g., directly faces, the first region.

The display apparatus further includes a control layer 3, e.g., a control circuit, for controlling operation statuses of the plurality of display units.

Figure 5:
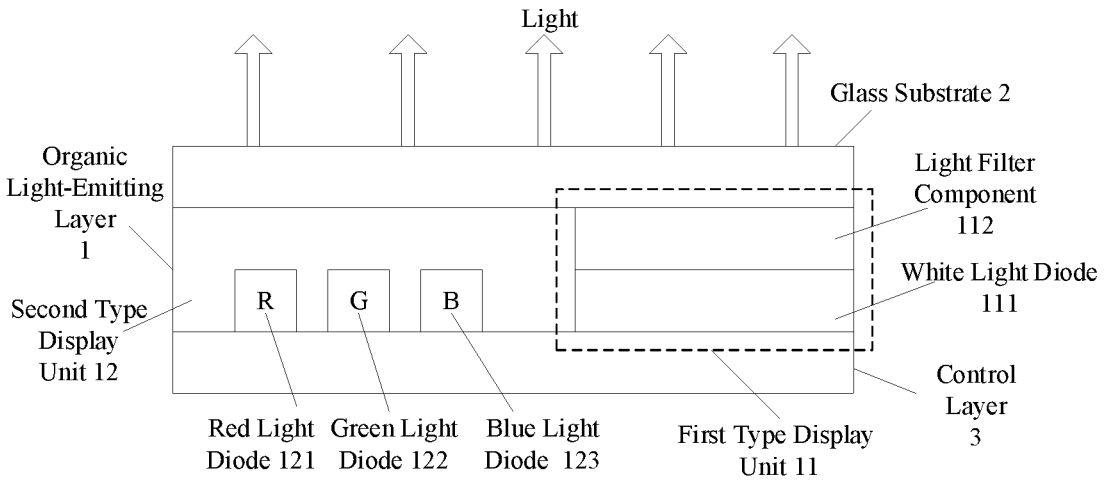
FIG. 5 is a schematic view of another example of OLED display apparatus consistent with disclosed embodiments.

That is, the display apparatus shown in FIG. 5 is similar to the display apparatus shown in FIG. 4, except that the display apparatus shown in FIG. 5 further includes the control layer 3 for controlling operation statuses of a plurality of display units. The control layer 3 may be electrically coupled to the plurality of display units. Signals and/or instructions sent from the control layer 3 may control statuses of the plurality of display units and/or adjust display parameters of the plurality of display units. In some embodiments, for each pixel of to-be-displayed (TBD) image data, the control layer 3 may determine a status of the display unit that corresponds to the pixel according to display parameters of the pixel. If the pixel corresponds to a first type display unit 11, the control layer 3 may control on/off statuses of corresponding white light diodes 111 and adjust luminance of the white light diodes 111 at on statuses according to the display parameters of the pixel. Accordingly, color light corresponding to the display parameters of the pixel may be formed by at least one of red light, green light, or blue light from the light filter components. If the pixel corresponds to a second type display unit 12, the control layer 3 may control on/off statuses of corresponding red light diode 121, green light diode 122, and blue light diode 123 and adjust display parameters of the red light diode 121, the green light diode 122, and the blue light diode 123 according to the display parameters of the pixel. Accordingly, color light corresponding to the display parameters of the pixel may be formed by at least one of red light, green light, or blue light that is adjusted. In some embodiments, the control layer can be implemented through a display interface coupled to a controller of an electronic device.

In the present disclosure, color display in the first region of the display output region of the display apparatus may be realized through a combination of white light diodes and light filter components, and color display in the second region of the display output region of the display apparatus may be realized through red light diodes, green light diodes, and blue light diodes. Under a same current condition, white light diodes may have relatively higher luminance, relatively longer lifetime, and relatively better stability than red light diodes, green light diodes, and blue light diodes. Accordingly, ghost images in the first region may be suppressed, and user visual experience may be improved.

The present disclosure further provides an electronic device. The electronic device may include an OLED display apparatus of the disclosure, such as one of the display apparatuses described in connection with FIGS. 1 to 5. The display apparatus includes an organic light-emitting layer 1 including a plurality of display units. The plurality of display units form a display output region of the display apparatus. The plurality of display units at least include a first type display unit 11. The first type display unit 11 includes a white light diode 111 and a light filter component 112 arranged in a light exit direction of the white light diode 111.

In some embodiments, the display apparatus may use the organic light-emitting layer 1 as a light source to realize a color display function, and light exit regions of the organic light-emitting layer 1 may correspond to an entire display output region of the display apparatus. The organic light-emitting layer 1 may include a plurality of display units, and the plurality of display units may at least include the first type display unit 11. The first type display unit 11 may include the white light diode 111 and the light filter components arranged in a light exit direction of the white light diode 111. The white light-emitting diode 111 may include, for example, a white OLED.

FIG. 2 is a schematic view of an example of first type display unit in an OLED display apparatus consistent with disclosed embodiments. In the example shown in FIG. 2, the first type display unit includes multiple light filter components 112, e.g., a red light filter component, a green light filter component, and a blue light filter component, as indicated by "R," "G," and "B" in the light filter components 112 shown in FIG. 2. The red light filter component (R), the green light filter component (G), and the blue light filter component (B) are arranged side by side. When the red light filter component, the green light filter component, and the blue light filter component receive white light emitted by the white light diode(s) 111, the red light filter component, the green light filter component, and the blue light filter component can emit red light, green light, and blue light, respectively. The red light, the green light, and the blue light can be combined to form color light. In some embodiments, one light filter component may be arranged in a light exit direction of each white light diode 111, and one light filter component may include a red light filter component, a green light filter component, or a blue light filter component. In some embodiments, for each pixel in the display output region corresponding to the first type display units 11, at least one group of white light diodes 111 may be provided. Each group of white light diodes 111 may include three white light diodes 111. A red light filter component, a green light filter component, and a blue light filter component may be arranged in the light exit directions of the three white light diodes 111, respectively. Operation statuses of the white light diodes 111 may be controlled to obtain color light. In some embodiments, for three white light diodes 111 corresponding to each pixel, whether each of the red light, the green light, and the blue light is emitted may be adjusted by controlling the on/off statuses of the three white light diodes 111. Display parameters of emitted red light, green light, and blue light may be adjusted by separately adjusting display parameters of the three white light diodes 111. Further, the emitted light may be combined to obtain color light corresponding to the pixel.

A thickness of the light filter component 112 may not exceed a preset threshold. The preset threshold may be, for example, approximately 0.5 mm. That is, the thickness of the light filter component 112 may not exceed approximately 0.5 mm. Accordingly, a thickness of the OLED display apparatus may be ensured to be, e.g., relatively small.

In some embodiments, the plurality of display units further include a second type display unit 12. The second type display unit 12 includes a red light diode 121, a green light diode 122, and a blue light diode 123.

The red light diode 121, the green light diode 122, and the blue light diode 123 may emit red light, green light, and blue light, respectively. Further, color light may be obtained through a combination of the red light, the green light, and/or the blue light. In some embodiments, for each pixel in a display output region corresponding to the second type display unit 12, at least one group of red light diode 121, green light diode 122, and blue light diode 123 may be provided. By controlling on/off statuses of the red light diode 121, the green light diode 122, and the blue light diode 123, whether each of the red light, the green light, and the blue light is emitted may be adjusted. Display parameters of emitted red light, green light, and blue light may be adjusted by separately adjusting display parameters of the red light diode 121, the green light diode 122, and the blue light diode 123. Further, the emitted light may be combined to obtain color light corresponding to the pixel.

In some embodiments, the plurality of display units may form a display output region of the display apparatus, and the display output region may include a first region and a second region. The first region may include an edge region corresponding to the second region, e.g., a region adjacent to an edge of the second region. The first region may include an edge region corresponding to one edge of the second region. The first region may have a smaller area than the second region. A length of a long side of the first region may be equal to a length of one side of the second region. In some embodiments, in order to further enlarge the display region to have a relatively broader coverage, for example, to obtain a full-screen electronic device, a first surface of the electronic device may include display screens, e.g., display output regions, in most regions of the first surface. However, since the first surface of the electronic device may need to include, e.g., a collection window for a camera or an earphone window, obtaining the relatively larger display region and the relatively broader coverage of the display region may result in irregular shape(s) in at least the display region(s) of the display screen. In some embodiments, the display apparatus may include a full-screen and may be used in an electronic device. Correspondingly, the full-screen may include a first region and a second region. A shape of the first region may include, for example, an irregular shape. In some embodiments, the OLED display apparatus may be used in an electronic device, and the first region located at the edge region corresponding to one edge of the second region may be compatible with an edge shape of a display output region of the electric device. In some embodiments, the first region may have a longer display time duration than the second region.

In some embodiments, the first region may correspond to the first type display units 11, and the second region may correspond to the second type display units 12. That is, the first region may use the white light diodes 111 as light-emitting sources, and the second region may use the red light diodes 121, the green light diodes 122, and the blue light diodes 123 as light-emitting sources, also referred to as "light sources."

In these embodiments, display of the first region corresponding to the first type display unit may output selected display contents. The selected display contents may be displayed in response to the electronic device being at a preset condition. A continuous display time duration of the selected display contents may exceed a preset time duration threshold.

In some embodiments, the first region may be an edge region corresponding to the second region, e.g., a region adjacent to an edge of the second region. That is, the first region may be considered as an edge region of the display output region of the electronic device. The edge region may be used for displaying selected display contents that may differ from display contents in the second region. In some embodiments, a processor of the electronic device may control, according to display contents, operation statuses of first type display units in the first region of the display screen and/or operation statuses of second type display units in the second region of the display screen. The second region may serve as a main display region for displaying contents, e.g., a main interface such as a home page, a webpage interface, and/or an application interface. The first region may not display contents displayed in the second region, e.g., the first region may display contents different from the contents displayed in the second region. That is, the first region may not display a main interface, a webpage interface, an application interface, or the like. In response to obtained display contents being a main interface, a webpage interface, an application interface, or the like, the processor may control operation statuses of second type display units in the second region of the display screen, such that the obtained display contents may be displayed in the second region. The selected display contents may include an icon of selected application program. The application program can also be referred to as an "application." The selected application program may include an application program that the user often uses. In some embodiments, the icon of selected application program displayed in the first region may be configured by the user. In some embodiments, selected information may be displayed in the first region. The selected information may include, for example, time information, prompt information of an instant messaging message, or the like. In response to obtained display contents being the selected display contents, the processor may control operation statuses of first type display units in the first region of the display screen, such that the display contents may be displayed in the first region. In some embodiments, the display units in the display regions of the display screen may operate together, but display contents of the first region may differ from display contents of the second region. In response to desktop icons being displayed in the display interface of the electronic device, in some embodiments, selected display contents may be displayed in the first region. In some other embodiments, the two regions, i.e., the first and second regions, may display one display content together, such that the user can use a relatively larger display region of the full screen and have more immersive user experience in browsing or operating the display content, such as a game interface, a video interface, or the like. In some embodiments, a user operation to turn off display of the first region may be supported. That is, statuses of the first type display units in the first region may be turned off. For example, because the irregular shape exists in the full screen, in response to the full screen displaying a maximized interface for a game interface or a video interface that has a standard dimension layout of a rectangle, or the like, lack of some contents in the full screen may occur at positions corresponding to an indentation, e.g., an irregular shape, formed for a camera, an earphone, or the like. Correspondingly, the user may turn off the first type display units of the first region through a system setting, a control button, or a virtual button. After the first type display units are turned off, the electronic device may determine that valid display region includes only the second region. Accordingly, an interface similar to a game interface or a video interface may be automatically switched from a full screen, e.g., the entire display region, to the second region of the full screen for displaying. That is, a maximized interface of the video interface or the game interface may be displayed only in the second region. In some embodiments, the electronic device may determine, according to the display content, that the display content is similar to a game interface or a video interface; and may directly control the display content to be displayed in only the second region, i.e., control second type display units in the second region to be at an operation status, and hold first display units in the first region at an off status or turn off first display units in the first region.

In some embodiments, selected display contents of the first region may be outputted and displayed in response to the electronic device being at a preset status, e.g., the electronic device being at a standby status. The standby status may refer to, e.g., a status that the electronic device operates in a low power consumption manner. In conventional technologies, the display screen can be turned off to save resources. In some embodiment, in response to the electronic device being at the standby status, at least the second type display units in the second region may be at an off status, and the selected display contents may be displayed through the first region, and further the first display units of the first region may be turned off after a preset time, such that the entire region of the display screen may be at an off status. In response to the electronic device receiving a new message/new notification during the standby status, only the first display units of the first region may be turned on to display an identification of the new message/new notification. That is, the second type display units in the second region may remain at the off status. After the user operates the identification of the new message/new notification, the second type display units in the second region may be turned on to display the new message/new notification. In response to the user directly waking up or turning on the electronic device from the standby status, the first type display units of in the first region and the second type display units in the second region may be turned on together.

In some embodiments, the second region may have a relatively higher resolution than the first region. In some embodiments, a resolution of the second region may be a full high definition (HD) resolution. For example, the resolution of the second region may reach 1920×1080p. A resolution of the first region may be an HD resolution. For example, the resolution of the first region may reach 1024×720p.

In some embodiments, the display apparatus further includes a glass substrate 2. Light filter components 112 of the first type display unit are arranged in a region at an inner surface of the glass substrate 2, and the region at the inner surface corresponds to the first region. The glass substrate 2 protects the organic light-emitting layer 1. The light filter component 112 can be realized in a form of color thin film. By a spray-coating method, the color thin film can be spray-coated at an inner surface of the glass substrate 2 and in a region corresponding to the first region. Since the thin film is relatively thin, a thickness of the light filter component 112 can be reduced by spay-coating the thin film to form the light filter component 112. Accordingly, a thickness of the display apparatus can be reduced.

In some embodiments, the display apparatus further includes a control layer 3 for controlling operation statuses of a plurality of display units.

In some embodiments, the control layer 3 may be electrically coupled to the plurality of display units. Signals and/or instructions sent from the control layer 3 may control statuses of the plurality of display units and/or adjust display parameters of the plurality of display units. In some embodiments, for each pixel of to-be-displayed (TBD) image data, the control layer 3 may determine a status of the display unit corresponds to the pixel according to display parameters of the pixel. If the pixel corresponding to a first type display unit 11, the control layer 3 may control on/off statuses of corresponding white light diodes 111 and adjust luminance of the white light diodes 111 at on statuses according to the display parameters of the pixel. Accordingly, color light corresponding to the display parameters of the pixel may be formed by at least one of red light, green light, or blue light from the light filter components. If the pixel corresponds to a second type display unit 12, the control layer 3 may control on/off statuses of corresponding red light diode 121, green light diode 122, and blue light diode 123 and adjust display parameters of the red light diode 121, the green light diode 122, and the blue light diode 123 according to the display parameters of the pixel. Accordingly, color light corresponding to the display parameters of the pixel may be formed by at least one of red light, green light, or blue light that is adjusted. In some embodiments, the control layer can be implemented through a display interface coupled to a controller of an electronic device.

In the present disclosure, color display in the first region of the display output region of the display apparatus may be realized through a combination of white light diodes and light filter components, and color display in the second region of the display output region of the display apparatus may be realized through red light diodes, green light diodes, and blue light diodes. Under a same current condition, white light diodes may have relatively higher luminance, relatively longer lifetime, and relatively better stability than red light diodes, green light diodes, and blue light diodes. Accordingly, ghost images may be suppressed in the first region for continuously displaying selected display contents, and user visual experience may be improved.

The foregoing description of the embodiments of the disclosure has been presented for purposes of illustration and description. It is not intended to be exhaustive or to limit the disclosure to the precise form or to example embodiments disclosed. Accordingly, the foregoing description should be regarded as illustrative rather than restrictive. Obviously, many modifications and variations will be apparent to persons skilled in this art. The embodiments are chosen and described in order to explain the principles of the technology, with various modifications suitable to the particular use or implementation contemplated. It is intended that the scope of the invention be defined by the claims appended hereto in which all terms are meant in their broadest reasonable sense unless otherwise indicated. Therefore, the term "the disclosure," "the present disclosure," or the like does not necessarily limit the claim scope to a specific embodiment, and the reference to example embodiments of the disclosure does not imply a limitation on the invention, and no such limitation is to be inferred. Moreover, the claims may refer to "first," "second," etc., followed by a noun or element. Such terms should be understood as a nomenclature and should not be construed as giving the limitation on the number of the elements modified by such nomenclature unless specific number has been given. Any advantages and benefits described may or may not apply to all embodiments of the disclosure. It should be appreciated that variations may be made to the embodiments described by persons skilled in the art without departing from the scope of the present disclosure. Moreover, no element or component in the present disclosure is intended to be dedicated to the public regardless of whether the element or component is explicitly recited in the following claims.

What is claimed is:

1. A display apparatus comprising:

an organic light-emitting layer including a plurality of display units, wherein:

the plurality of display units include one or more first type display units in a first display region of the display apparatus and one or more second type display units in a second display region of the display apparatus, the second display region being arranged at an edge of the organic light-emitting layer, the first display region being configured to display selected display contents in response to the display apparatus being at a preset condition, the preset condition including the display apparatus being in a standby mode and receiving a new message, wherein in the standby mode, the second display region is turned off, each of the one or more first type display units includes one or more white light diodes and one or more light filter components each arranged in a light exit direction of one of the one or more white light diodes, and each of the one or more second type display units includes a red light diode, a green light diode, and a blue light diode.

2. The apparatus according to claim 1, wherein the first display region is arranged in connection with an edge of the second display region.

3. The apparatus according to claim 1, further comprising:

a glass substrate, wherein the one or more light filter components of each of the one or more first type display units are arranged at an inner surface of the glass substrate in a region corresponding to the first display region.

4. The apparatus according to claim 1, further comprising:

a control circuit, the control circuit is coupled to the plurality of display units and controls operation statuses of the plurality of display units.

5. The apparatus according to claim 1, wherein a thickness of the one or more light filter components equals or is smaller than a preset threshold.

6. The apparatus according to claim 5, wherein the preset threshold is approximately 0.5 mm.

7. An electronic device comprising:

a display apparatus including:

an organic light-emitting layer including a plurality of display units, wherein:

the plurality of display units include one or more first type display units in a first display region of the display apparatus and one or more second type display units in a second display region of the display apparatus, the second display region being arranged at an edge of the organic light-emitting layer, the first display region being configured to display selected display contents in response to the electronic device being at a preset condition, the preset condition including the display apparatus being in a standby mode and receiving a new message, wherein in the standby mode, the second display region is turned off, each of the one or more first type display units includes one or more white light diodes and one or more light filter components each arranged in a light exit direction of one of the one or more white light diodes, and each of the one or more second type display units includes a red light diode, a green light diode, and a blue light diode.

8. The electronic device according to claim 7, wherein a continuous display time duration of the selected display contents exceeds a preset time duration threshold.

9. The electronic device according to claim 7, wherein:

a resolution of the second display region is higher than a resolution of the first display region.

* * * * *